US007963246B1

(12) United States Patent
Brinker

(10) Patent No.: US 7,963,246 B1
(45) Date of Patent: Jun. 21, 2011

(54) APPARATUS FOR CONTROLLED APPLICATION OF AN ADHESIVE BEAD TO A WORKPIECE

(75) Inventor: Timothy J. Brinker, Hillsboro, OH (US)

(73) Assignee: Henline Adhesive Equipment Co., Inc., Loveland, OH (US)

( * ) Notice: Subject to any disclaimer, the term of this patent is extended or adjusted under 35 U.S.C. 154(b) by 531 days.

(21) Appl. No.: 12/228,586

(22) Filed: Aug. 14, 2008

Related U.S. Application Data

(60) Provisional application No. 60/964,606, filed on Aug. 14, 2007.

(51) Int. Cl.
*B05C 11/00* (2006.01)
*B05B 13/02* (2006.01)
*B05B 7/12* (2006.01)

(52) U.S. Cl. ..... 118/712; 118/305; 118/684; 118/686; 239/407

(58) Field of Classification Search ..... 118/300, 118/305, 712, 713, 665, 686–688, 684, 321, 118/323; 239/407, 436, 569, 68; 156/578; 427/256, 8
See application file for complete search history.

(56) References Cited

U.S. PATENT DOCUMENTS

| | | | | |
|---|---|---|---|---|
| 6,170,760 | B1 * | 1/2001 | Bievenue et al. | 239/407 |
| 2003/0137080 | A1 * | 7/2003 | Bouras et al. | 264/272.11 |
| 2004/0028830 | A1 * | 2/2004 | Bauer | 427/421 |
| 2004/0081759 | A1 * | 4/2004 | Maruyama et al. | 427/256 |

* cited by examiner

*Primary Examiner* — Yewebdar T Tadesse
(74) *Attorney, Agent, or Firm* — Charles R. Wilson

(57) ABSTRACT

An apparatus is designed to apply a controlled adhesive bead to a workpiece as the workpiece is manually moved along a stationary adhesive dispensing mechanism. The apparatus comprises a worktable with a motion detection device mounted on a top surface of the table, the adhesive dispensing mechanism mounted to the worktable, an electronic control system mounted to the worktable and operatively connected to the motion detection device and the adhesive dispensing mechanism, and an adhesive source. The workpiece is manually moved under the dispensing mechanism. Regardless of the workpiece movement speed, a consistent sized adhesive bead is applied to the workpiece.

10 Claims, 6 Drawing Sheets

APPARATUS FOR CONTROLLED APPLICATION OF AN ADHESIVE BEAD TO A WORKPIECE

This application claims the benefit of U.S. Provisional Application No. 60/964,606, filed Aug. 14, 2007.

FIELD OF THE INVENTION

This invention relates to an apparatus for applying adhesive to a workpiece. More particularly, the invention relates to an apparatus for applying a controlled adhesive bead to a workpiece in response to signals generated by manual movement of the workpiece.

BACKGROUND OF THE INVENTION

Certain industrial operations require that an adhesive be applied to a part during an assembly line process. For example, a window or door frame will require that a bead of adhesive be applied along a grooved recess of the frame which is intended as a seat for a glass pane. Necessarily, a uniform amount of adhesive in a well defined bead height and bead width must be applied to avoid waste and excess clean-up. Underapplication of the adhesive to the frame is to be avoided as well because of a possible structural failure.

There are different methods to apply adhesive in an assembly line process envisioned herein. In one method, an adhesive applicator is mounted on a gantry associated with a worktable. As the workpiece moves onto the worktable, the gantry and its adhesive applicator move in a pattern which is pre-set to the desired adhesive bead deposit. Complicated linear motion devices are needed to move the adhesive applicator along the workpiece surface. In another method, movement of the adhesive applicator is done manually. This method has inherent problems of worker error or fatigue. The adhesive applicator can also be programmed and coupled with complex linear motion devices.

There is a need for an adhesive applicator apparatus which is capable of applying a uniform bead of adhesive to a workpiece regardless of assembly line speed, and regardless of workpiece shape. The apparatus must be easy to use, easy to understand and easy to maintain. In accord with a long felt need in a number of industrial facilities manufacturing various products, there has now been developed an adhesive apparatus meeting the known needs.

SUMMARY OF THE INVENTION

An apparatus for controlled application of adhesive to a manually moved workpiece comprises a worktable, an adhesive dispensing mechanism, an electronic control system, and an adhesive source. The worktable is for receiving the workpiece. It includes a motion detection device which detects movement of the workpiece and sends signals to the electronic control system for processing. The worktable further has the adhesive dispensing mechanism mounted on it. The mechanism has a valve body with an inlet port for receiving adhesive from the adhesive source and a nozzle with an outlet port. A flow adaptor is mounted in the nozzle, and along with the valve needle, controls the flow of adhesive from the valve body through the nozzle's orifice. The valve needle is operatively connected to a linear motor which in turn is responsive to signals received from the electronic control system. Manual movement of the workpiece on the worktable across the motion detection device causes the adhesive dispensing mechanism to dispense an adhesive bead onto the workpiece. The electronic control system is able to ensure that a constant volume of adhesive in a bead of consistent width and height is laid onto the workpiece.

DETAILED DESCRIPTION OF THE INVENTION

The apparatus of the invention is described in detail in the following paragraphs and with reference to the drawings. It is described with reference to the controlled application of an adhesive bead to a window frame. The apparatus is useful for applying adhesive to other workpieces regardless of size or shape.

As used here, adhesive is used to describe all manner of materials which have an adhering effect of holding two substrates together. It is intended to encompass sealants, glues and other materials of similar characteristics.

Figure 1:
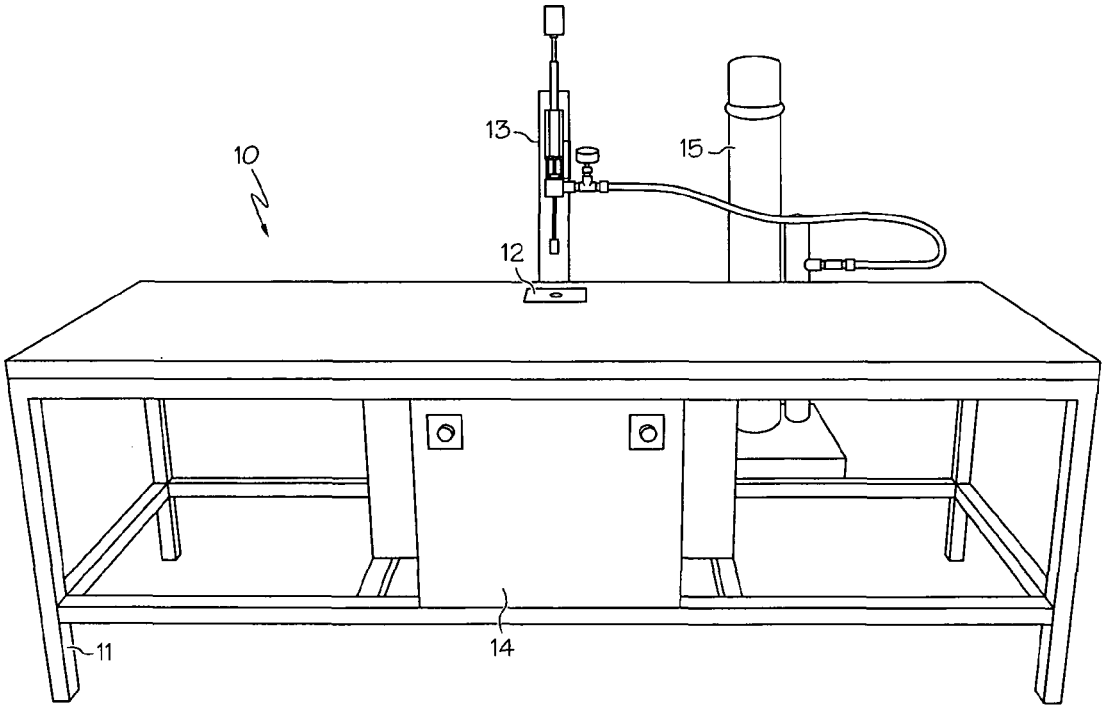
FIG. 1 is a perspective view of the apparatus of the invention showing a worktable with a motion detection device, an adhesive dispensing mechanism, an electronic control system, and an adhesive source.
Figure 7:
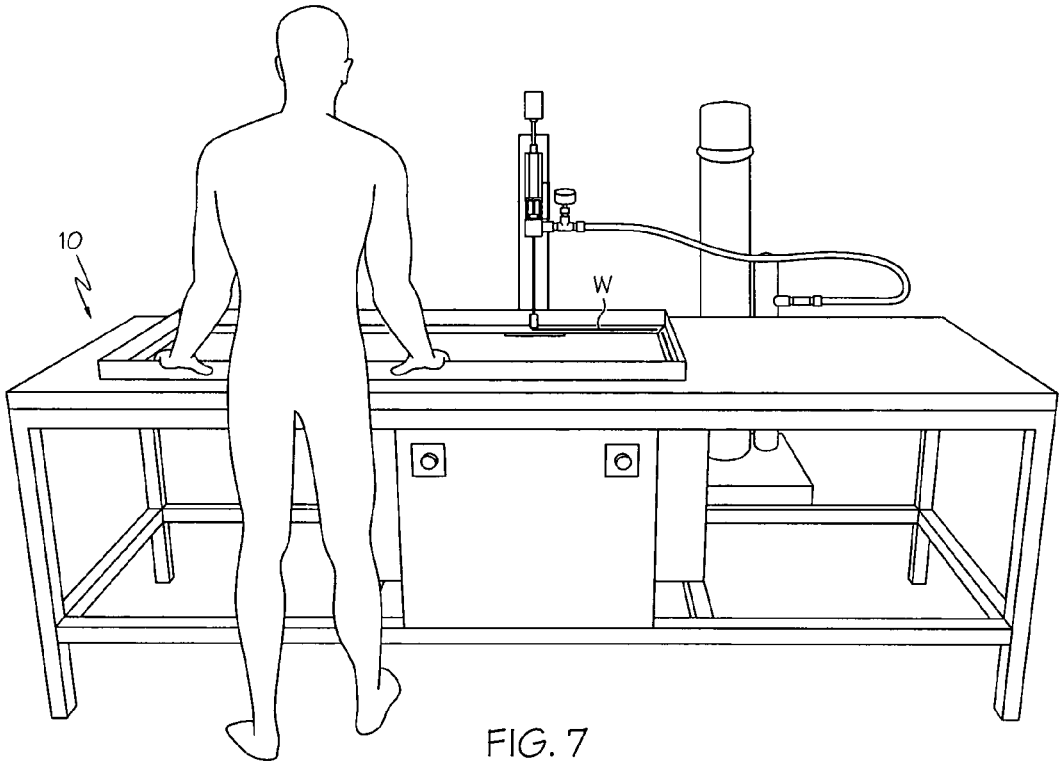
FIG. 7 is an environmental view of the apparatus of FIG. 1 showing a workpiece on a worktable in process of manual movement during an adhesive application step.

With reference to FIGS. 1 and 7, there is shown the apparatus of the invention with a workpiece W in the process of having an adhesive bead applied to it. The apparatus comprises a worktable 11 with a motion detection device 12, an adhesive dispensing mechanism 13, an electronic control system mounted on the worktable and designated generally as 14, and an adhesive source 15. Each component of the apparatus is discussed in detail as well as interactions of the components and operation of the apparatus.

Figure 2:
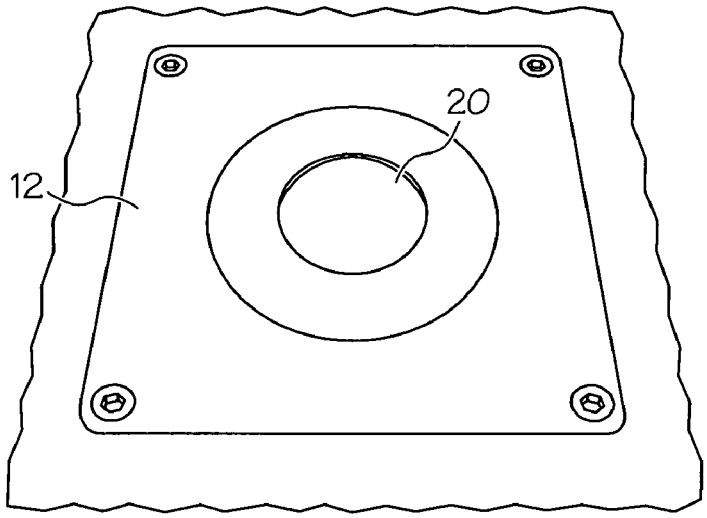
FIG. 2 is a perspective view of the motion detection device mounted in a top surface of the worktable of FIG. 1.
Figure 3:
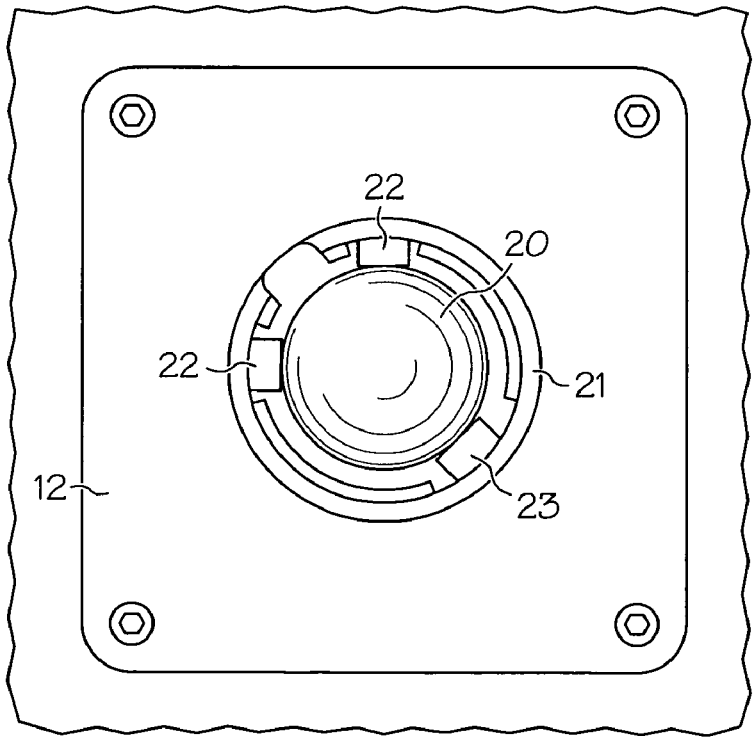
FIG. 3 is a top view of the motion detection device of FIG. 2 with a cover removed to show encoder wheels.

Still with reference to FIG. 1, the worktable is conventional in design. Its work surface is as large as need be to handle the workpiece to be processed. The motion detection device 12 mounted on the surface of the worktable 11 is conventional in nature. Its purpose is to detect any motion of the workpiece across its surface. As shown in FIGS. 2 and 3, the motion detection device 12 has a rotating ball 20 mounted in a housing 21 so that the ball's surface extends slightly above the top surface of the worktable. The ball 20 is in contact with two encoder wheels 22 mounted in the housing 21 and at about 90 degree spacing to each other. The encoder wheels 22 are coupled to a pair of encoders that feed data to the electronic control system 14. A tension wheel 23 forces the ball 20 against the encoder wheels 22. Thus, the motion detection device detects motion of the workpiece, particularly the workpiece's speed and direction. It also detects speed of workpiece movement. Both pieces of data are necessary to have a controlled application of adhesive to the workpiece regardless of irregular workpiece movement speeds caused by the apparatus' operator.

The adhesive dispensing mechanism 13 is responsive to signals received from the electronic control system 14. It is mounted on the worktable 11 in a fixed location. It has three modes of operation. First, there is a home mode where the valve of the mechanism is retracted and will not dispense adhesive. Second, there is a position mode where the valve is down allowing precise placement of the nozzle relative to the workpiece but without dispensing adhesive. Third, there is a run mode where the valve dispenses adhesive when the workpiece is moved and thereby detected by the motion detection device and stops dispensing adhesive when the workpiece stops. Button controls (not shown) are used by the operator to select the desired mode.

Figure 4:
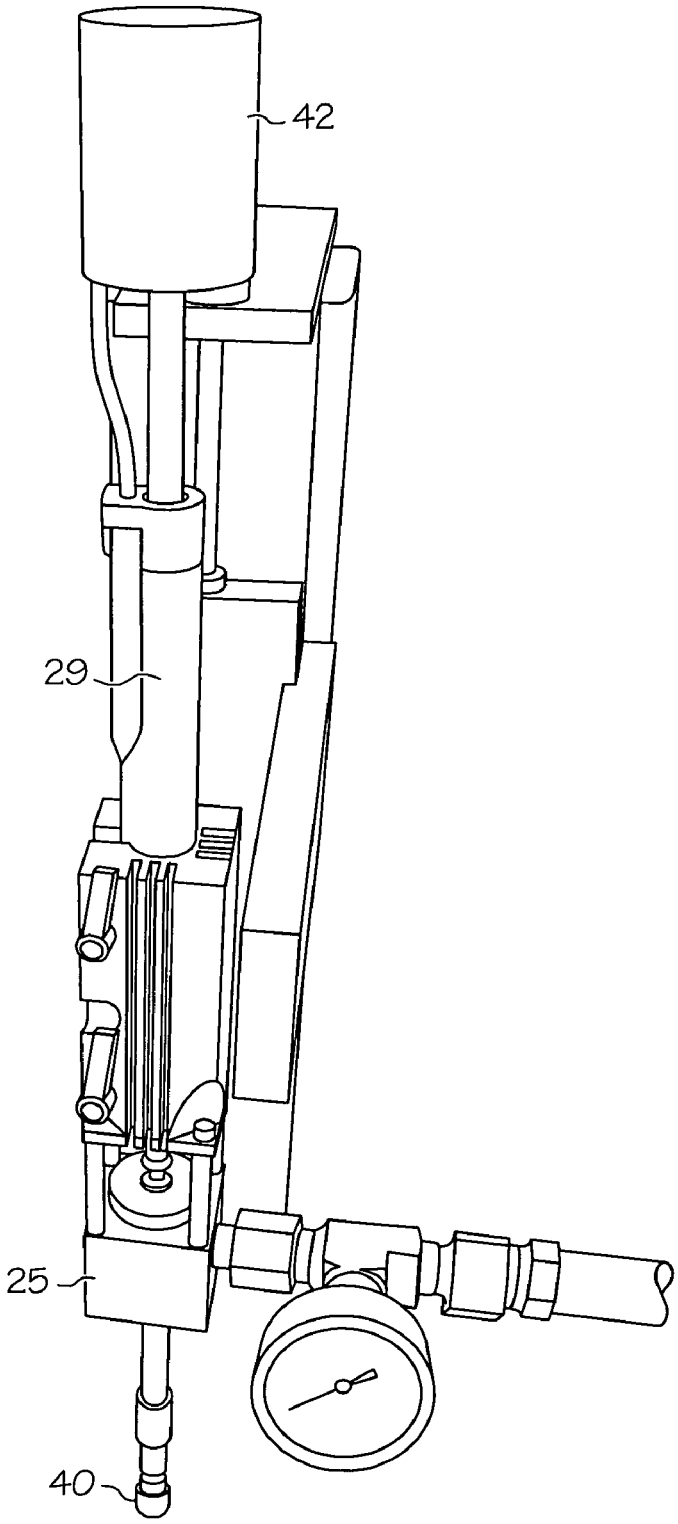
FIG. 4 is a perspective view showing the adhesive dispensing mechanism of FIG. 1.
Figure 5A:
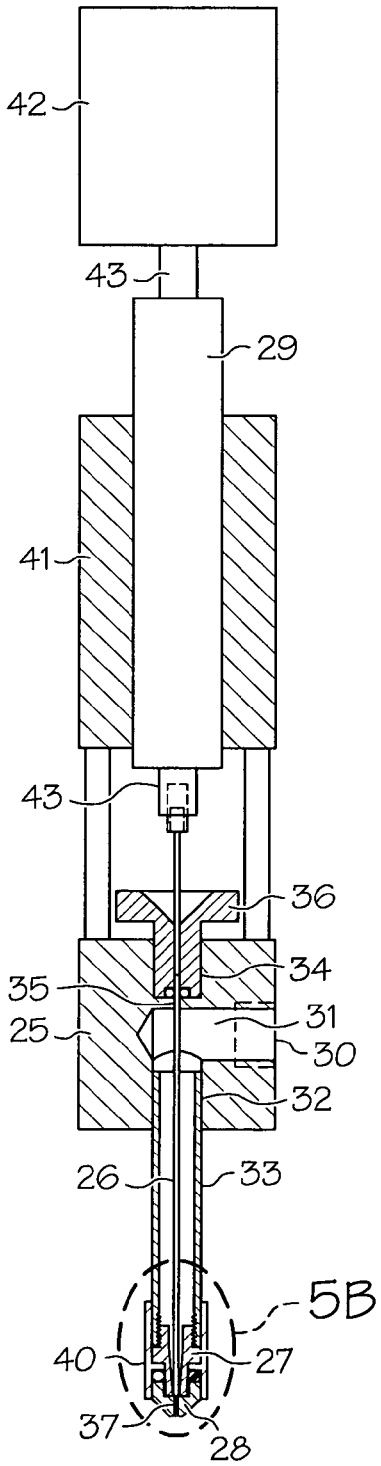
FIG. 5A is a front view in section of the adhesive dispensing mechanism of FIG. 4.

The adhesive dispensing mechanism 13 is designed to dispense adhesive in a controlled amount in response to a signal and to immediately stop dispensing the adhesive without oozing at its nozzle, also in response to a signal. As seen in FIGS. 4 and 5A, the adhesive dispensing mechanism 13 has a valve body 25, a valve needle 26, a flow adaptor 27, a nozzle 28, and a linear motor 29 as essential components.

As best seen in FIG. 5A, the valve body 25 includes an inlet port 30 for receiving the adhesive through a tube from the adhesive source 15. A reservoir 31 within the valve body 25 is provided to receive and hold adhesive. A heating element can be associated with the reservoir if desired. The valve body also has a bore hole 32 extending vertically from the valve body's bottom surface to the reservoir 31. A needle housing 33 is secured into the bore hole 32 and extends through the valve body. A packing nut seat 34 and needle bore hole 35, opposed to the bore hole 32 extends from the valve body's upper surface. A packing nut 36 is dimensioned to fit into the packing nut seat 34. The needle bore hole 35 extends to the reservoir 31.

The valve needle 26, used to control the flow of adhesive through the nozzle 28, extends through the packing nut 36, the needle bore hole 35, the reservoir 31 and the needle housing 33. A first end is connected to the linear motor 29 and a second end terminates within the nozzle 28. In use, the valve needle 26 moves from a closed position in sealing contact with an orifice 37 of the nozzle 28 to a fully open position wherein the nozzle's orifice is unobstructed.

The nozzle 28 is secured to the flow adaptor 27 to provide a desired adhesive bead profile in terms of its width and height, and consequently volume. Several nozzle sizes are available depending on the adhesive and adherence needs of the particular workpiece. With reference to FIGS. 4 and 5A, a part guide 40 is positioned over the nozzle 28. The part guide is cylindrical-shaped and encompasses sides of the nozzle. It simply moves along the workpiece to aid in precise adhesive placement. The part guide has various diameters depending on the workpiece to provide a controlled adhesive bead offset.

The linear motor 29 is mounted on the valve body 25 by a linear motor clamp 41. The linear motor is connected to the electronic control system and responds to signals emanating therefrom. Thus, the linear motor is directly coupled to the valve needle for fast and accurate response to signals from the electronic control system. Linear motors are well known. The linear motor is used in the adhesive dispensing mechanism 13 to obtain the benefit of its inherent high speed and fast response time. A weight 42 is positioned on the stator 43 of the linear motor to counter balance upward pressure exerted on the needle due to a pressure differential resulting from the adhesive source as it pumps adhesive into the valve body.

Figure 5B:
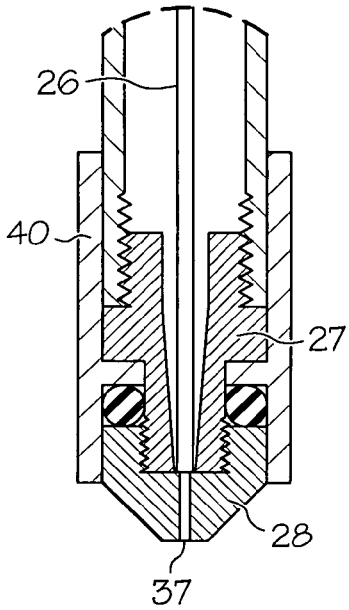
FIG. 5B is an enlarged view in section of the nozzle with the flow adaptor taken along line 5B of FIG. 5A.

As best seen in FIG. 5B, the flow adaptor 27 is positioned within the nozzle 28. The flow adaptor 27 is a fitting threaded on its outside to mate with inside threads in the nozzle. It further has a tapered cavity through which the valve needle 26 extends. The tapered cavity of the flow adaptor in conjunction with the valve needle's movement therewithin ensures the consistent flow of adhesive through the orifice, regardless of workpiece speed. Adhesive enters the larger diameter end of the tapered cavity and is forced into the increasingly more narrow cavity until it exits through the orifice 37 of the nozzle 28.

Figure 6:
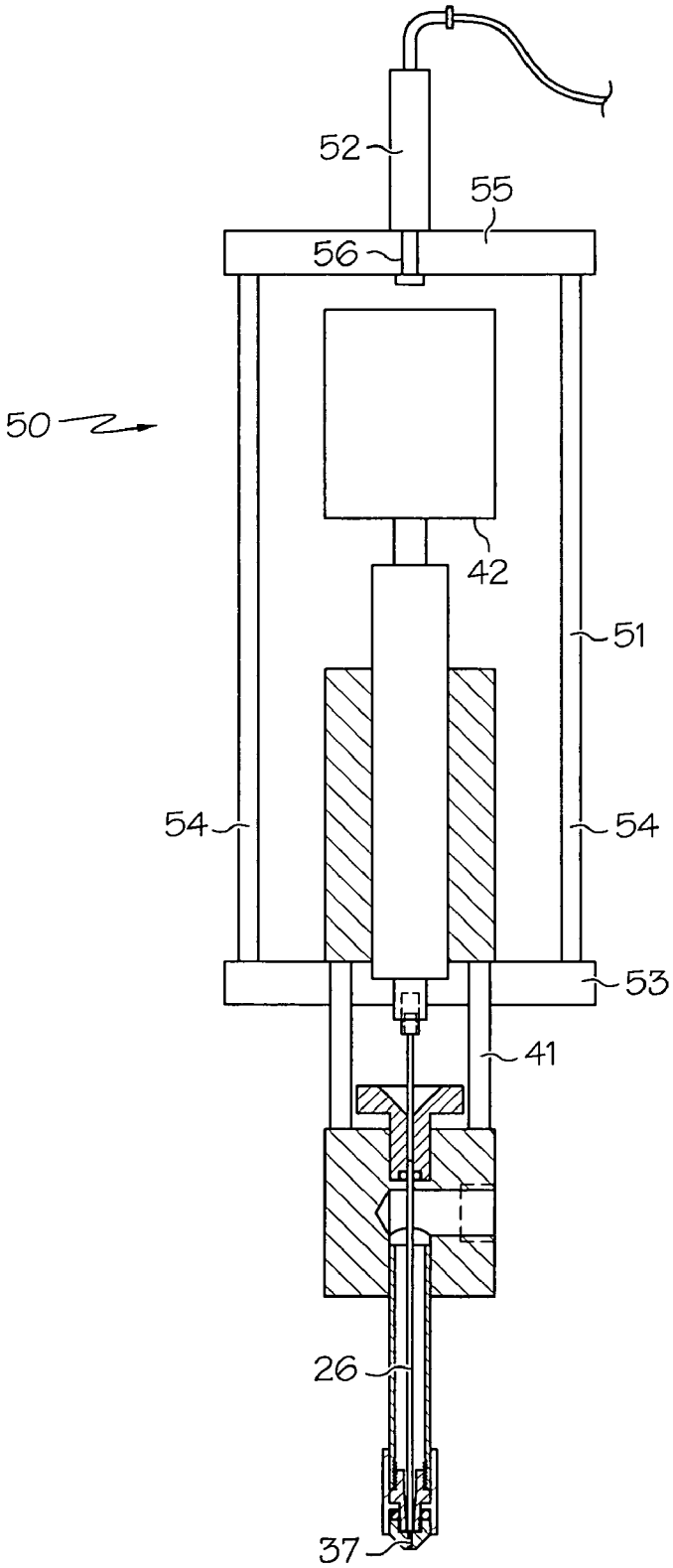
FIG. 6 is a side view in section of the adhesive dispensing mechanism of FIG. 5A with a seal assist mounted thereon for alleviating adhesive ooze when an adhesive application process stops.

It is highly preferred that a seal assist be attached to the adhesive dispensing mechanism to alleviate adhesive oozing at the nozzle's orifice when an adhesive application step is stopped. Now with reference to FIG. 6, the seal assist 50 includes a frame 51 and an air cylinder 52. The frame 51 has a base 53 secured to the linear motor 29. Legs 54 extend from the base 53 along the linear motor 29 and beyond the weight 42 to terminate slightly above the weight's top surface. A cap head 55 extends between the terminuses of the legs. The air cylinder 52 is mounted on the cap head 55. A plunger 56 from the air cylinder extends through a centrally located hole in the cap head 55 and is in position to impact a force on the weight 42 upon its activation. The plunger activation occurs when the adhesive application step stops as discussed further below. This in turn quickly forces the valve needle 26 to move downwardly to seal shut the nozzle's orifice.

The electronic control system 14 mounted on the worktable controls the adhesive dispensing and stopping steps to ensure that a consistent adhesive bead in terms of volume and size is always applied to the workpiece. It receives signals from the encoders of the motion detection device, applies it to a special algorithm and transmits signals to a servo that controls the linear motor 29 associated with the adhesive dispensing mechanism 13. Regardless of the workpiece speed as it is manually moved on the worktable surface, there is a constant adhesive bead dispensed from the dispensing mechanism onto the workpiece.

Again with reference to FIG. 1, the adhesive source 15 is simply a container of adhesive with a pump for pumping the adhesive to the adhesive dispensing mechanism 13 through a tube in a well known fashion. A constant pressure is maintained on the adhesive.

In operation as seen in FIG. 7, the workpiece W to receive adhesive as part of an assembly process is placed on the worktable. No special set-up from workpiece to workpiece is needed. The workpiece is properly positioned under the nozzle of the adhesive dispensing mechanism. At the initial stage, the mechanism is in a home mode. Its valve is retracted up and will not dispense adhesive. It is next put into a position mode where the valve of the mechanism is down to allow precise placement of its part guide to the workpiece, yet without dispensing adhesive. Finally, it is placed in the run mode. The valve now dispenses adhesive when the workpiece is moved. Adhesive dispensing is terminated when the workpiece stops moving, such as at a corner where a direction change necessitates stoppage. Resumption of workpiece movement by the operator resumes the adhesive application in the same controlled adhesive amount. The workpiece with its uniformly applied adhesive bead in place is now moved to the next workstation.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. An apparatus for controlled application of adhesive to a manually moveable workpiece, said apparatus comprising:

(a) a worktable for receiving the workpiece, said worktable having a motion detection device mounted on its surface for detecting movement of the workpiece;

(b) an adhesive dispensing mechanism for dispensing adhesive onto the workpiece in response to signals generated by the motion detection device, said adhesive dispensing mechanism mounted on the worktable and having a valve body with an inlet port for receiving adhesive, a retractable valve needle extending through the valve body, a nozzle with an outlet port, a flow adaptor positioned within the nozzle whereby the valve needle extends into the flow adaptor and controls adhesive flowing through the outlet port, a part guide encompassing the nozzle for guiding the nozzle along the workpiece, and a linear motor operatively connected to the valve needle for extending or retracting the valve needle in response to a signal;

(c) an electronic control system for receiving signals from the motion detection device and for sending signals to the adhesive dispensing mechanism for supplying a controlled amount of adhesive to the workpiece as it is manually moved about the worktable; and (d) an adhesive source operatively connected to the adhesive dispensing mechanism for supplying pressurized adhesive thereto.

2. The apparatus of claim 1 wherein the motion detection device includes a housing, a rotating ball mounted in the housing such that a top surface of the ball extends slightly above a top surface of the worktable, two rollers mounted in the housing at about 90 degree spacing to one another and in contact with the ball for detecting movement of the ball in response to movement of the workpiece and for feeding data to the electronic control system.

3. The apparatus of claim 2 wherein the motion detection device further comprises a tension wheel mounted in the housing for constant forcing of the rotating ball against the two encoder wheels.

4. The apparatus of claim 1 wherein the adhesive dispensing mechanism is mounted on the worktable in a fixed location.

5. The apparatus of claim 4 wherein the adhesive dispensing mechanism is mounted on the worktable for substantially vertical movement.

6. The apparatus of claim 4 wherein the adhesive dispensing mechanism has three modes of operation comprising a home mode wherein the needle valve is retracted and will not dispense adhesive, a position mode wherein the needle valve is down for precise placement of the workpiece, and a run mode for dispensing adhesive when the workpiece is moved.

7. The apparatus of claim 6 wherein the flow adaptor mounted in the nozzle of the adhesive dispensing mechanism has a tapered cavity through which the valve needle extends for ensuring consistent flow of adhesive through the nozzle's orifice.

8. The apparatus of claim 7 wherein the linear motor of the adhesive dispensing mechanism further has a weight positioned on a stator of the linear motor for counterbalancing pressure exerted on the valve needle by the pressurized adhesive.

9. The apparatus of claim 8 wherein the adhesive dispensing mechanism further comprises a seal assist for alleviating adhesive oozing at the nozzle's orifice when adhesive application is stopped, said seal assist having a frame mounted to the linear motor and an air cylinder with a plunger mounted on the frame in position to exert a force upon the weight by the plunger in response to a signal from the electronic control system.

10. An apparatus for controlled application of adhesive to a manually moveable workpiece, said apparatus comprising:

(a) a worktable for receiving the workpiece, said worktable having a motion detection device mounted on its surface for detecting movement of the workpiece;

(b) an adhesive dispensing mechanism for dispensing adhesive onto the workpiece in response to signals generated by the motion detection device, said adhesive dispensing mechanism mounted on the worktable and having a valve body with an inlet port for receiving adhesive, a retractable valve needle extending through the valve body, a nozzle extending from the valve body with an outlet port, a flow adaptor positioned within the nozzle whereby the valve needle extends into the flow adaptor and controls adhesive flowing through the outlet port, a part guide encompassing the nozzle for guiding the nozzle along the workpiece, a linear motor operatively connected to the valve needle for extending or retracting the valve needle in response to a signal and a seal assist, said seal assist having a frame mounted to the linear motor and an air cylinder with a plunger mounted on the frame in position to exert a force upon the weight by the plunger in response to a signal from the electronic control system;

(c) an electronic control system for receiving signals from the motion detection device and for sending signals to the adhesive dispensing mechanism for supplying a controlled amount of adhesive to the workpiece as it is manually moved about the worktable; and (d) an adhesive source operatively connected to the adhesive dispensing mechanism for supplying pressurized adhesive under pressure to the adhesive dispensing mechanism.

* * * * *